United States Patent [19]

Sansevero et al.

[11] Patent Number: 5,020,654

[45] Date of Patent: Jun. 4, 1991

[54] CURVED ESCALATOR STEP CHAIN TURNAROUND ZONE

[75] Inventors: Frank Sansevero, West Hartford, Conn.; Klaus Seehausen, Niedernwohren, Fed. Rep. of Germany; James A. Rivera, Bristol, Conn.

[73] Assignee: Otis Elevator Company, Farmington, Conn.

[21] Appl. No.: 576,535

[22] Filed: Aug. 31, 1990

[51] Int. Cl.[5] ..... B66B 21/02

[52] U.S. Cl. ..... 198/328; 198/329

[58] Field of Search ..... 198/328, 778, 831, 334, 198/845, 329

[56] References Cited

U.S. PATENT DOCUMENTS

| | | | |
|---|---|---|---|
| 3,419,127 | 12/1968 | Yost | 198/329 X |
| 4,730,717 | 3/1988 | Sugita | 198/328 |
| 4,739,870 | 4/1988 | Saito | 198/328 |
| 4,746,000 | 5/1988 | Nakatani et al. | 198/328 |
| 4,809,840 | 3/1989 | Nakatani | 198/328 |

*Primary Examiner*—D. Glenn Dayoan

*Attorney, Agent, or Firm*—William W. Jones

[57] ABSTRACT

The curved escalator has inner and outer step chains that are entrained on inner and outer sprockets which have different diameters, the outer sprocket having a larger diameter than the inner sprocket. The steps of the escalator reverse their direction of movement at the sprockets and pass from the passenger bearing run to a return run beneath the passenger bearing run. One of the sprocket sets is the power or driving set and the other is an idler set, which will be spring biased to maintain chain tension. In order to reverse the steps, they must tip or dip sideways because of the different sized sprockets. The dip zone of the roller tracks has an S curve to minimize noise and allow location of the track splice on the tensioned end of the escalator to be placed over the axis of rotation of the tensioned sprockets.

6 Claims, 3 Drawing Sheets

CURVED ESCALATOR STEP CHAIN TURNAROUND ZONE

TECHNICAL FIELD

This invention relates to curved escalators and, more particularly, to the dip zone geometry for a curved escalator.

BACKGROUND ART

Escalators that travel along a path which is curved in plan view are generally described in the prior art. Such escalators are generally graceful and impressive, but present many complexities due to the third dimension involved in their construction. It will be appreciated that the outer step rollers on a curved escalator will have to move faster than the inner step rollers since the distance they travel between landings is greater than the distance traveled by the inner rollers. This problem has been solved in the prior art in U.S. Pat. No. 4,730,717 granted Mar. 15, 1988 to K. Sugita by providing two different diameter drive and reversal sprockets for the inner and outer step chains, both mounted on a common shaft. The outer sprocket is larger than the inner sprocket, thus its teeth move faster than the teeth of the inner sprocket. This causes the outer step chain to move faster than the inner step chain. A complication that results from such a solution is that the steps must tip when they pass over the drive and return sprockets. When the steps have intermeshing cleats on the risers and adjacent tread edges, provisions must be made to avoid jamming of the cleats when the steps are thus tipped.

Curved escalators also experience considerable side thrust due to the path of travel, whereby the steps are pulled toward the center of the curved path along which they travel. This problem can be overcome by the inclusion of side thrust rollers on the chains which may engage the outside surface of the inner or outer step tracks, as shown in U.S. Pat. No. 4,739,870 granted Apr. 26, 1988 to R. Saito. The curved escalators, like linear escalators, will have one set of sprockets which are powered, and thus are drive sprockets, and will have at the opposite landing a set of idler sprockets which simply guide the step chains around the reversal, and are not directly powered. It is conventional as shown in U.S. Pat. No. 3,419,127 granted Dec. 31, 1968 to H.R. Yost, which is incorporated herein by reference, to provide a tension carriage for the idler sprockets, whereby the idler sprockets will be biased on a sliding carriage in a direction away from the drive sprockets. This ensures a constant tension on the step chains and thus prevents step chain sag. Since the step chains can stretch due to the tensioned idler sprockets, the tracks over which the step rollers move must also have some axial flexibility. This problem has been solved by providing a splice in the tracks as shown in U.S. Pat. No. 4,739,870 and others. A complicating factor which is not addressed in the prior art relates to the side thrust rollers, which will also have to negotiate a track splice. The splice disclosed in the 4,739,870 patent cannot be quietly and smoothly negotiated by the curved escalator's side thrust rollers.

One more complicating factor arising in connection with the curved escalator relates to the track path of the inner step rollers as the inner track passes from its position parallel with the outer track wherein the step treads are horizontal, to the inner sprockets, wherein the inner track is not parallel with the outer track, and the step treads are tipped. U.S. Pat. Nos. 4,746,000 granted May 24, 1988 to H. Nakatani discloses an inner track that dips along a rectilinear path from its horizontal position down toward the inner sprocket. This type of arrangement is not desirable for several reasons. First, when the step rollers move from the horizontal part of the track into the rectilinear dip zone, they will make distinct noise, which is not desirable. Secondly, at the idler sprocket end of the escalator, the track splice must be on a horizontal part of the track since the tension carriage slides horizontally. The part of the track that moves will be mounted on the tension carriage, and the rest will be mounted on the escalator truss. An arrangement which places as little of the track as possible on the tension carriage is the most desirable arrangement. With the rectilinear dip zone shown in the prior art, the track splice must be placed before the dip zone, thus the entire dip zone and part of the horizontal track zone are all mounted on the tension carriage, and not on the escalator truss. This will unduly stress the tension carriage.

DISCLOSURE OF THE INVENTION

This invention relates to a curved escalator which has a curvilinear track dip zone, and a track splice that can accommodate the side thrust rollers as well as the standard rollers on the escalator steps. The track dip zone is preferably in the form of an S curve which smoothly carries the rollers as the steps dip from their horizontal to their tipped positions. The dip zone includes a horizontal portion leading into the inner sprocket whereby the track splice can be positioned very closely to the vertical plane containing the center point, or axis of rotation of the inner sprocket. Thus a minimum amount of track is carried on the tension carriage.

It is therefore an object of this invention to provide a curved escalator assembly having an improved dip zone for tipping the steps as they pass over the turnaround sprockets.

It is a further object of this invention to provide an escalator assembly of the character described wherein the dip zone roller tracks are curvilinear.

It is a further object of this invention to provide an escalator assembly of the character described wherein a track splice is placed on a horizontal portion of the track between the dip zone and the inner sprocket.

It is another object of this invention to provide an escalator assembly of the character described wherein the track splice can smoothly support conventional and side thrust step rollers.

These and other objects of the invention will become more readily apparent from the following detailed description of a preferred embodiment thereof when taken in conjunction with the accompanying drawings, in which:

BEST MODE FOR CARRYING OUT THE INVENTION

Figure 1:
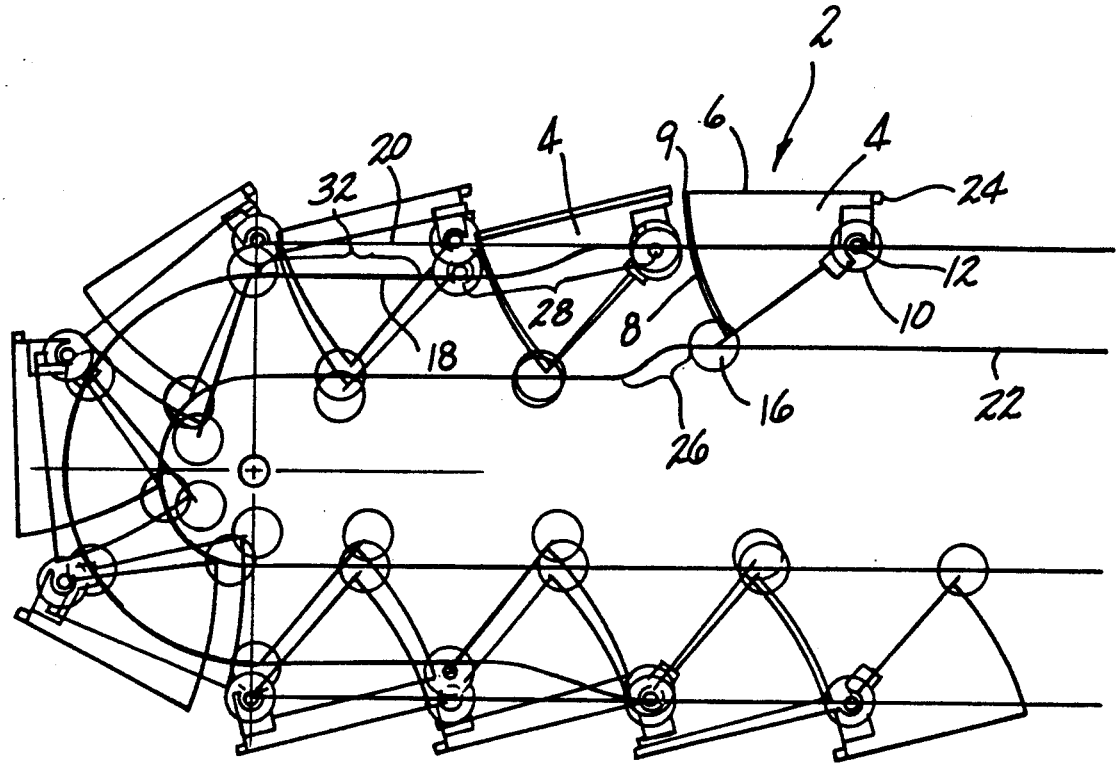
FIG. 1 is a schematic side elevational view of a planar projection of the landing, dip and reversal zones of a curved escalator formed in accordance with this invention.
Figure 2:
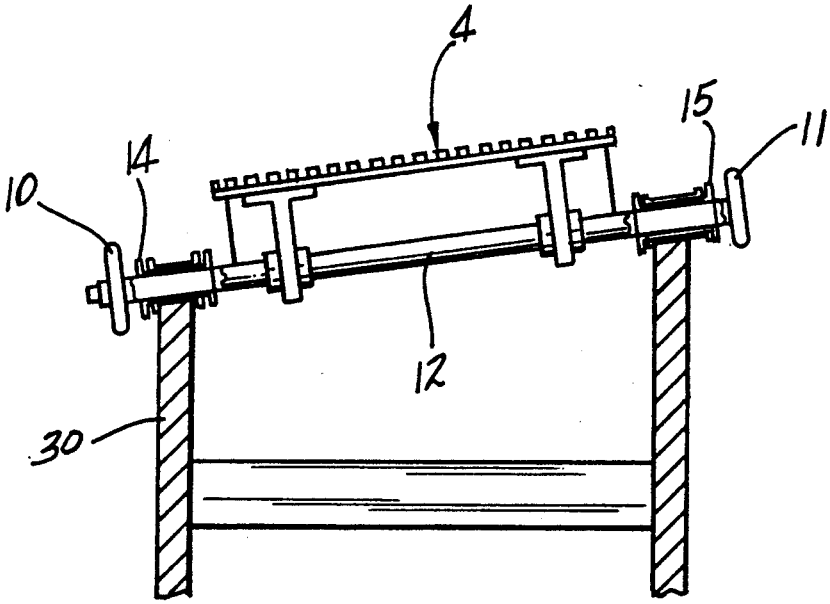
FIG. 2 is a fragmented sectional view of the inner and outer chain sprockets showing how the steps dip as they pass over the sprockets.

Referring now to FIGS. 1 and 2, there is shown a landing zone of a curved escalator, denoted generally by the numeral 2, and its accompanying dip zone and step reversal zone. The movement of the steps 4 shown in FIG. 1 occurs after the steps have passed underneath the landing comb plate. Each step 4 includes a tread 6 on which passengers stand; a riser 8; inside and outside step chain rollers 10 and 11 respectively which are connected to an axle 12 which in turn is connected to the inside and outside step chains 14 and 15 respectively; and a trailer roller 16 disposed at the bottom of the riser 8. The step chain rollers 10 move over inner and outer tracks 18 and 20, which are coplanar in the passenger-carrying portions of the path of travel so that the step tread 6 stays horizontal. The trailer rollers move over their own tracks 22 which, in the landing zones lie below the step chain roller tracks 18 and 20. The step tread 6 has cleats 24 which project beyond the edge 26 of the treads and mesh with complementary cleats 9 on the risers 8. After the steps 4 have passed beneath the comb plate, the trailer rollers 16 pass over a drop zone 26 on the tracks 22 which causes the steps 4 to tip forwardly disengaging the tread cleats and riser cleats. The outside step chain 15 continues along the same path of travel 20 but the inside step chain rollers 10 pass over a dip zone 28 as they advance toward the inside step chain sprocket 30, thus causing the steps 4 to tip as shown in FIG. 2. The zones 26 and 28 on the tracks 22 and 18 respectively are curvilinear and have an S shape. Using the S shape results in a quieter escalator, and also provides a horizontal section 32 which leads into the circumference of the sprocket 30. This horizontal section 32 is where the track splice is placed at the tension carriage end of the escalator 2.

Figure 3:
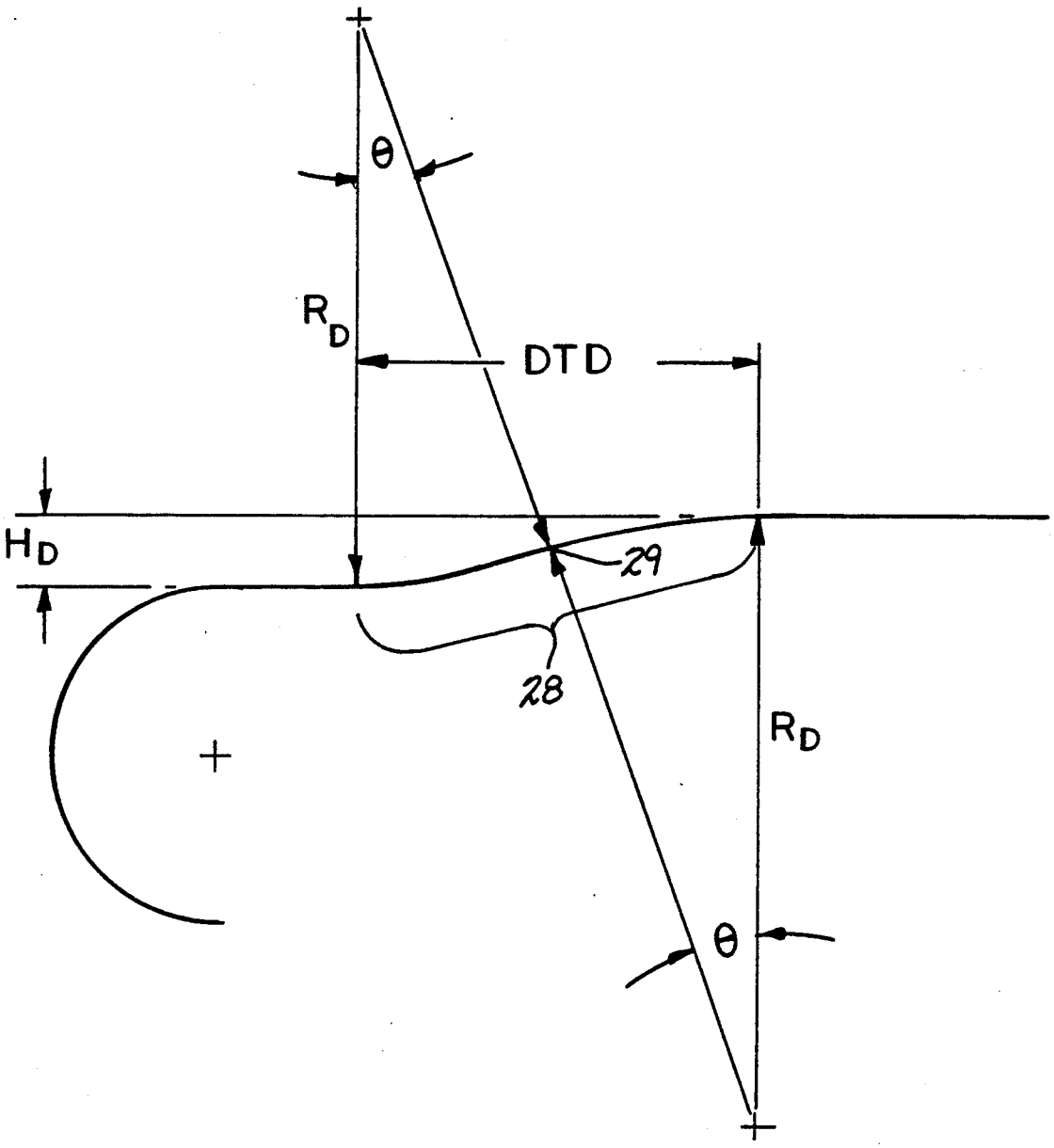
FIG. 3 is a planar projection of the dip zone showing how the proper track path is identified.

Referring to FIG. 3, the geometry of the dip zone 28 is shown in detail. The dip zone 28 consists of two identical curves of radius $R_D$ which merge at midpoint 29. The distance DTD is the planar projection length in the horizontal plane of the dip zone 28, and the dimension $H_D$ is the vertical drop of the dip zone 28, which is simply the difference between the radii of the inner and outer return sprockets. The angle $\Theta$ is the included angle between the ends of the dip zone 28 and its midpoint 29. For any given escalator, the radii of the return sprockets will be known, thus the value of $H_D$ will be fixed. A desirable dimension for the length of the dip zone DTD will be selected. $R_D$ and $\Theta$ are then calculated by solving the equations:

$$R_D = \frac{DTD^2}{4H_D} + \frac{H_D}{4}\text{; and}$$

$$\theta = \arcsin\left[\frac{DTD}{2R_D}\right]$$

Once $R_D$ and $\Theta$ are calculated, the dip zone can be formed in its S curve configuration.

Figure 4:
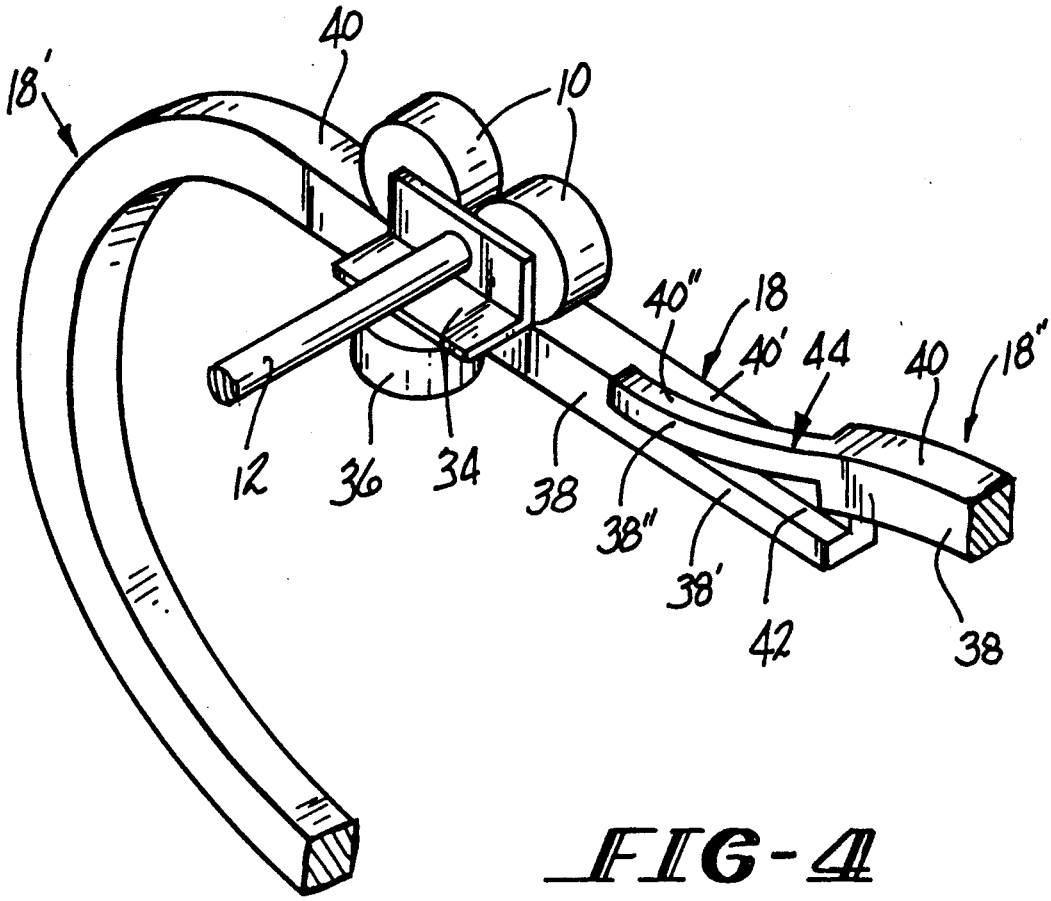
FIG. 4 is a fragmented perspective view of the inner track splice adjacent to the dip zone.
Figure 5:
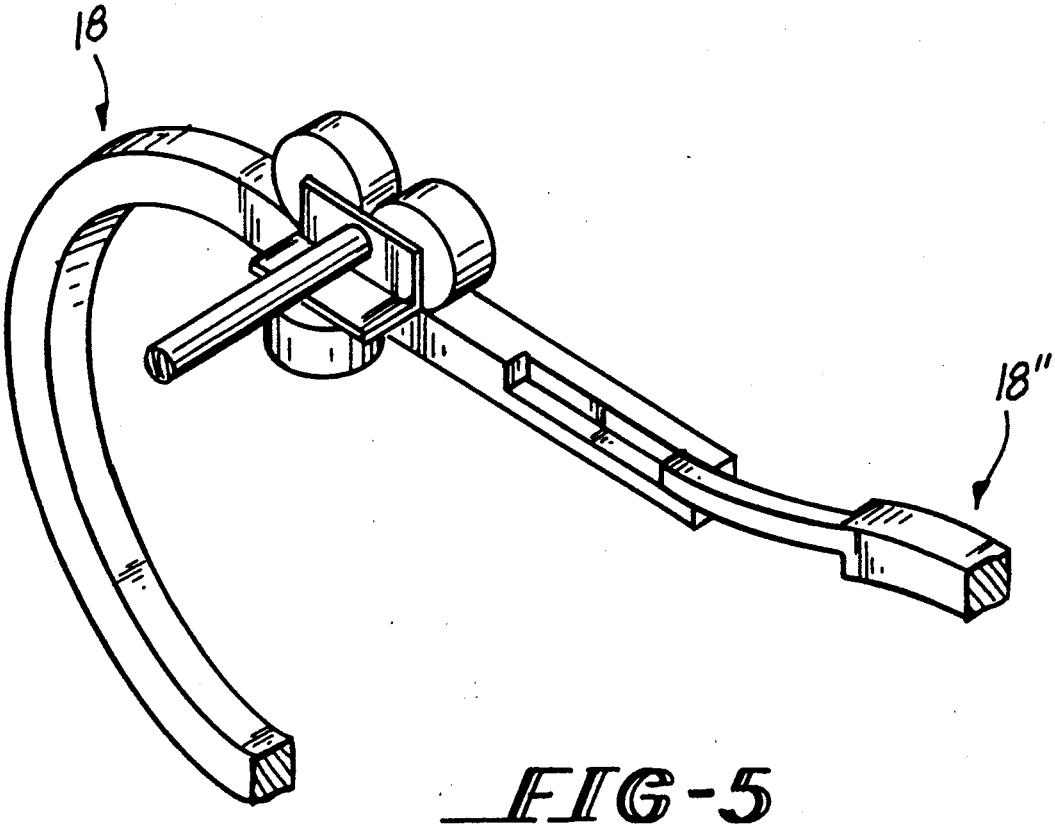
FIG. 5 is a view similar to FIG. 4, but showing the splice in its expanded condition.

Referring now to FIGS. 4 and 5, the track splice in the inner step chain roller track 18 is shown. It is noted that the inner end of the step axle 12 carries a bracket 34 on which a pair of step axle rollers 10 and a side thrust roller 36 are journaled. The side thrust roller 36 engages the outer side surface 38 of the track 18 and the axle rollers 10 ride on the top surface 40 of the track 18. The splice is made by forming a notch 42 in the track 18 which is bounded by parts 38' and 40' of the side and top surfaces 38 and 40 of the track 18. A finger 44 which has side and top surface parts 38" and 40", and which conforms to the notch 42 is slideably disposed in the latter. The track 18 is thus divided into two separate parts, one 18' of which is mounted on the tension carriage, and the other 18" of which is mounted on the escalator truss. The dip zone S curve is preferably formed on the track finger 44 with the track part 18' preferably including the horizontal post dip zone portion 32 of the track (as shown in FIGURE 1). This arrangement allows the dip zone S curve to terminate as closely as possible to the vertical plane of symmetry of the sprocket 30, thus minimizing the amount of track on the tension carriage. It will be noted that the splice surfaces 40' and 40" will guide the step axle rollers 10, and surfaces 38' and 38" will guide the thrust roller 36. Smooth and quiet movement over the splice is thus accomplished. FIG. 5 shows how the splice continues to operate properly even when the track part 18' is pulled away from the track part 18" by the tension carriage.

It will be readily appreciated that the curved escalator of this invention will provide a smooth, quiet turnaround of the steps while providing continuous resistance to side thrust of the steps. The track splice accommodates the use of a tension carriage on the escalator, and guides and supports the step rollers without any discontinuities.

Since many changes and variations of the disclosed embodiment of the invention may be made without departing from the inventive concept, it is not intended to limit the invention otherwise than as required by the appended claims.

What is claimed is:

1. An escalator assembly having a series of steps which follow a path of travel which is curved in plan view and which includes a passenger conveying upper portion, and a return portion which underlies said passenger conveying portion, said steps being connected together by radially inner and outer step chains entrained on respective inner and outer sprockets at opposite ends of the escalator and operable to transfer said steps from said passenger conveying to said return portions of said path of travel, and reverse, said inner sprocket having a smaller radius than said outer sprocket; and said escalator assembly including inner and outer tracks which carry inner and outer step rollers journaled on said steps, said inner track defining a dip zone adjacent to said inner sprocket where said steps are shifted from a horizontal position to a tilted position preparatory to engaging said sprockets, said inner track dip zone having a smooth S-shaped curve when viewed in elevation.

2. The escalator assembly of claim 1 wherein said inner track dip zone includes a horizontal section leading to the circumference of said inner sprocket.

3. The escalator assembly of claim 2 wherein said inner track dip zone S curve is formed by two opposite arcs having identical radii and having identical included angles, said arcs meeting at a midpoint of said S curve.

4. The escalator of claim 3 wherein said arc radius $R_D$ is defined by solving the equation:

$$R_D = \frac{DTD^2}{4H_D} + \frac{H_D}{4}\text{; wherein}$$

DTD is the length of the S curve in elevation; and $H_D$ is the difference between the outer sprocket radius and the inner sprocket radius; and the included angle Θ of the arc radius is defined by solving the equation:

$$\theta = \arcsin\left[\frac{DTD}{2R_D}\right]$$

5. The escalator assembly of claim 4 wherein said inner track includes a splice in said horizontal section, said splice being formed by overlapping fingers on said inner track.

6. An escalator assembly having a series of steps which follow a path of travel which is curved in plan view and which includes a passenger conveying upper portion, and a return portion which underlies said passenger conveying portion, said steps being connected together by radially inner and outer step chains entrained on respective inner and outer sprockets at opposite ends of the escalator and operable to transfer said steps from said passenger conveying to said return portions of said path of travel, and reverse, said inner sprocket having a smaller radius than said outer sprocket; and said escalator assembly including inner and outer tracks which carry inner and outer step rollers journaled on said steps, said inner step rollers including weight bearing rollers and side thrust rollers; and said inner track defining a dip zone adjacent to said inner sprocket where said steps are shifted from a horizontal position to a tilted position preparatory to engaging said sprockets, said inner track dip zone having a smooth S-shaped curve when viewed in elevation and a horizontal section of said inner track leading from said S curve to the circumference of said inner sprocket, said inner track having a splice in said horizontal section for accommodating chain tensioning movement of said sprockets, said splice being formed by overlapping fingers on said inner track which fingers include coplanar overlapping horizontal track surfaces for smooth engagement by said weight bearing rollers, and adjacent overlapping vertical track surfaces for smooth engagement by said side thrust rollers.

* * * * *